US012611041B2

(12) United States Patent
Nicholson

(10) Patent No.: US 12,611,041 B2
(45) Date of Patent: Apr. 28, 2026

(54) ADJUSTABLE HEADBOARD DEVICE

(71) Applicant: Kenneth Nicholson, Grand Rapids, MI (US)

(72) Inventor: Kenneth Nicholson, Grand Rapids, MI (US)

( * ) Notice: Subject to any disclaimer, the term of this patent is extended or adjusted under 35 U.S.C. 154(b) by 43 days.

(21) Appl. No.: 18/645,925

(22) Filed: Apr. 25, 2024

(65) Prior Publication Data

US 2025/0331648 A1 Oct. 30, 2025

(51) Int. Cl.
*A47C 19/02* (2006.01)
*A47C 19/12* (2006.01)

(52) U.S. Cl.
CPC ..... *A47C 19/022* (2013.01); *A47C 19/12* (2013.01)

(58) Field of Classification Search
CPC ... A47C 19/005; A47C 19/021; A47C 19/022; A47C 19/00; A47C 19/04; A47C 19/045; A47C 20/12
USPC ..... 5/661, 659, 53.2
See application file for complete search history.

(56) References Cited

U.S. PATENT DOCUMENTS 1,140,997 A * 5/1915 Minehart ..... A45C 9/00 297/380
2,236,152 A * 3/1941 Mckissick ..... A47C 3/16 297/380
2,429,795 A * 10/1947 Blanchard ..... A47C 16/005 297/118
2,941,215 A * 6/1960 Johnson ..... A61G 7/053 5/507.1
3,055,018 A 9/1962 Pink
3,140,897 A * 7/1964 Dougherty ..... A47C 20/027 297/229
5,642,451 A * 6/1997 Kennedy ..... G02B 6/2558 385/99
7,118,179 B1 10/2006 Wilson
8,262,157 B2 * 9/2012 Novak ..... A47C 1/146 297/16.2
D681,376 S 5/2013 Thomas
8,459,738 B2 * 6/2013 Downey ..... A47C 20/027 297/230.11
8,918,931 B1 * 12/2014 Baker ..... A47C 21/003 5/659
9,173,794 B2 11/2015 Rawls-Meehan
9,226,585 B1 * 1/2016 Bright ..... A47C 7/62
11,324,329 B2 * 5/2022 Maurer ..... A61G 7/0501
2007/0226900 A1 10/2007 Levinsohn
2013/0305459 A1 * 11/2013 Kaiser ..... A47C 19/022 5/658

(Continued)

FOREIGN PATENT DOCUMENTS

AU B3215289 9/1989

*Primary Examiner* — William Kelleher

(57) ABSTRACT

An adjustable headboard device includes a mattress panel which can be positioned beneath the mattress and a headboard hingedly coupled to the mattress panel for retaining pillows at a preferred orientation for user's sleeping position. A plurality of brackets is each attached to a respective one of the mattress panel and the headboard and a pair of arms is each pivotally attached to the brackets which are attached to the headboard. Each of the pair of arms has a plurality of engagement points and a respective engagement point on each arm is attachable to a respective one of the brackets which are attached to the mattress panel thereby retaining the headboard at an adjustable angle with respect to the mattress panel.

18 Claims, 7 Drawing Sheets

(56) References Cited

U.S. PATENT DOCUMENTS

| | | | | |
|---|---|---|---|---|
| 2015/0159686 | A1* | 6/2015 | Davotian | A47B 13/003 403/345 |
| 2018/0042391 | A1* | 2/2018 | Oh | A47C 19/027 |
| 2021/0386207 | A1* | 12/2021 | Deng | A47C 19/005 |
| 2022/0346559 | A1* | 11/2022 | Leng | A47C 17/1753 |

* cited by examiner

ADJUSTABLE HEADBOARD DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to headboard devices and more particularly pertains to a new headboard device for integrating a headboard into a mattress. The device includes a mattress panel that is positionable beneath a mattress and a headboard that is hingedly coupled to the mattress panel such that the headboard extends upwardly beyond the mattress. The device includes a pair of arms that are each pivotally attached to the headboard and which are each attachable to the mattress panel for retaining the headboard at a variety of angles with respect to the mattress panel.

(2) Description of Related Art including information disclosed under 37 CFR 1.97 and 1.98

The prior art relates to headboard devices including a variety of folding headboard devices that are structurally integrated into a bedframe and an adjustable bedframe device that includes a frame, slidably mounted to pair of rails, which includes a headboard section that is hingedly coupled to a mattress section and a plurality of headboard devices that each at least includes a cushioning element. In no instance does the prior art disclose a headboard device that includes a mattress panel that is slidable beneath a mattress and a headboard that is hingedly coupled to the mattress panel and a pair of arms pivotally attached to the headboard which are attachable to the mattress panel for retaining the headboard at a variety of angles.

BRIEF SUMMARY OF THE INVENTION

An embodiment of the disclosure meets the needs presented above by generally comprising mattress panel which can be positioned beneath the mattress and a headboard hingedly coupled to the mattress panel for retaining pillows at a preferred orientation for user's sleeping position. A plurality of brackets is each attached to a respective one of the mattress panel and the headboard and a pair of arms is each pivotally attached to the brackets which are attached to the headboard. Each of the pair of arms has a plurality of engagement points and a respective engagement point on each arm is attachable to a respective one of the brackets which are attached to the mattress panel thereby retaining the headboard at an adjustable angle with respect to the mattress panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
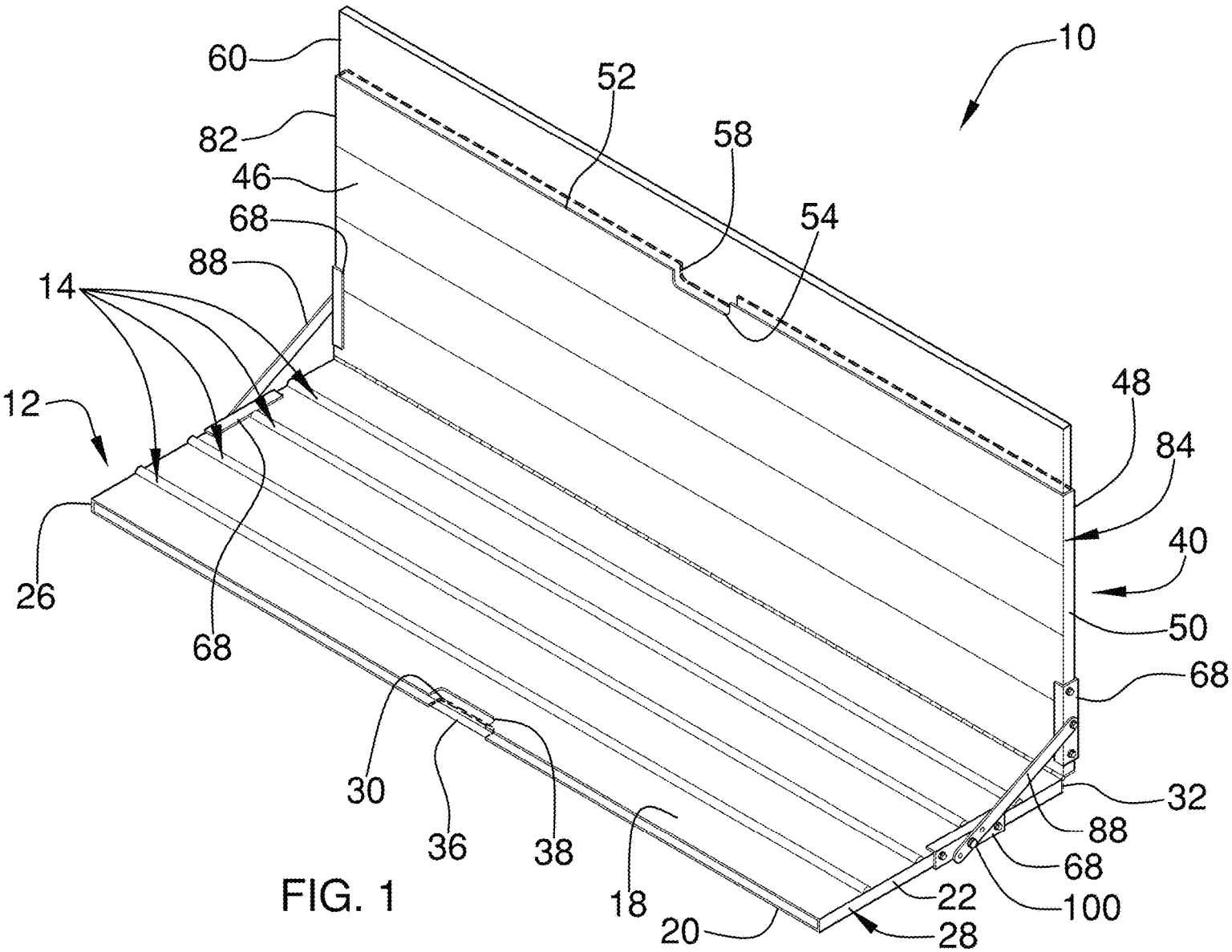
FIG. 1 is a top perspective view of an adjustable headboard device according to an embodiment of the disclosure.
Figure 2:
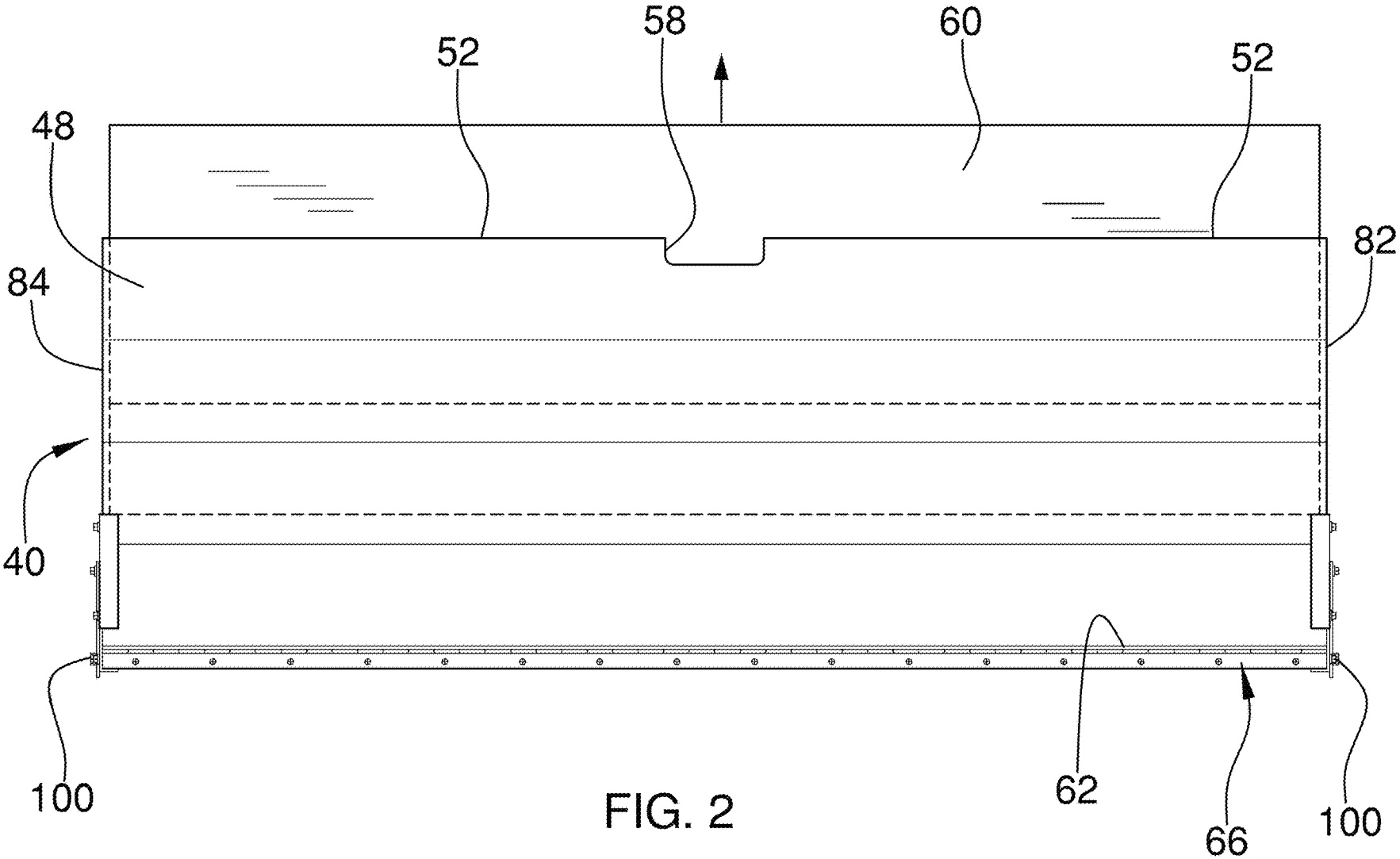
FIG. 2 is a back view of an embodiment of the disclosure.
Figure 3:
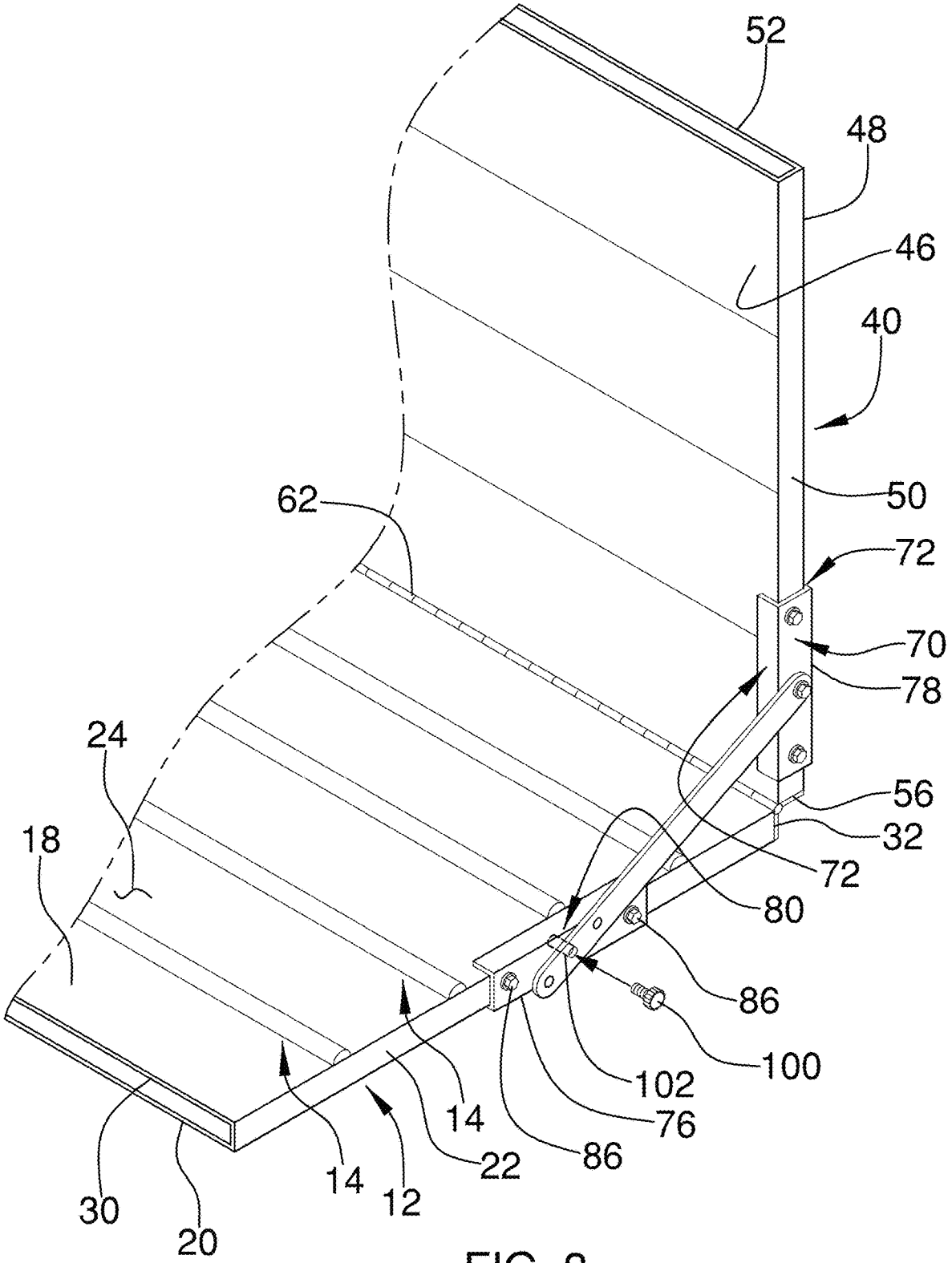
FIG. 3 is an exploded perspective view of an embodiment of the disclosure showing a screw being inserted into a well.
Figure 4:
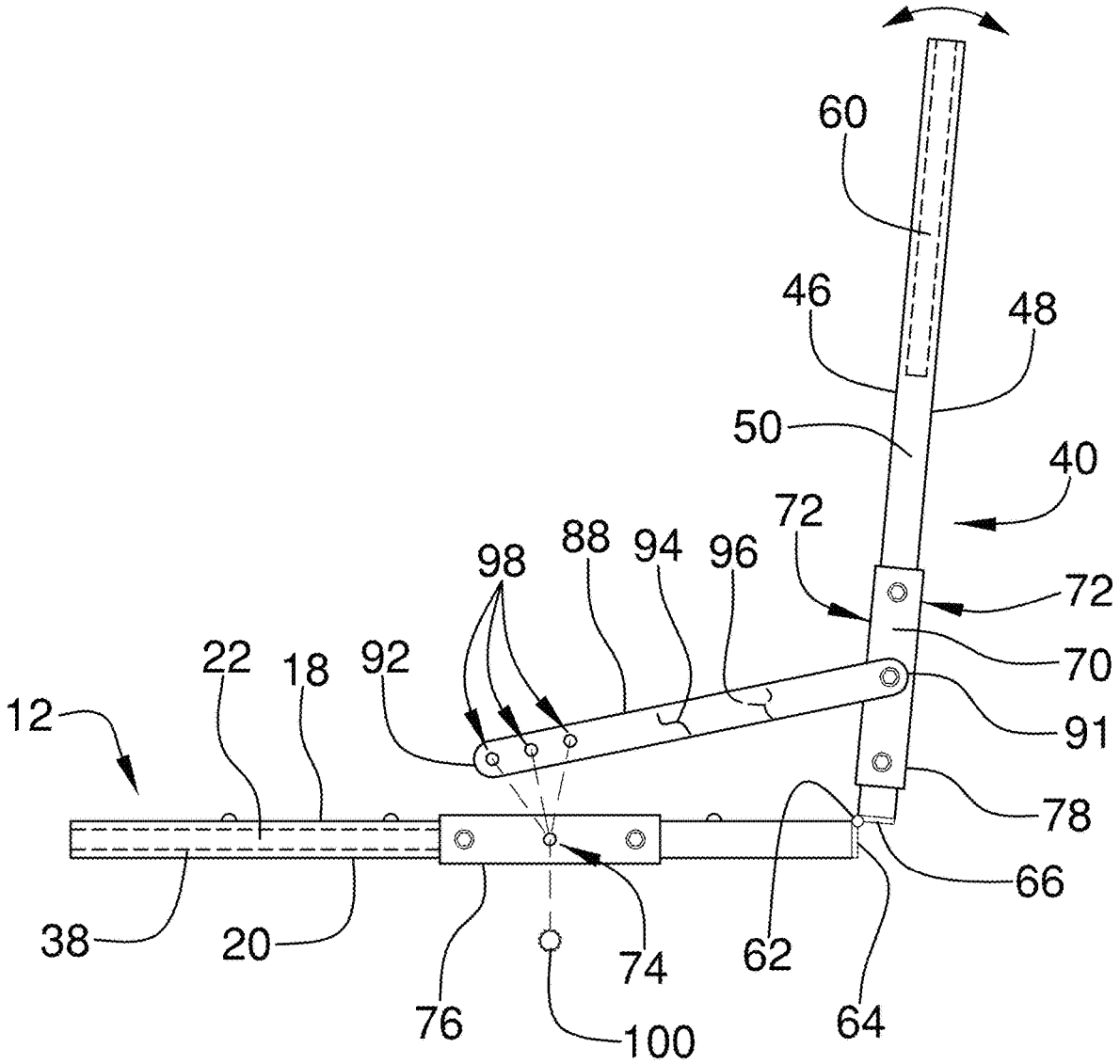
FIG. 4 is a left side view of an embodiment of the disclosure showing an arm being positioned for attaching to a mattress panel.
Figure 5:
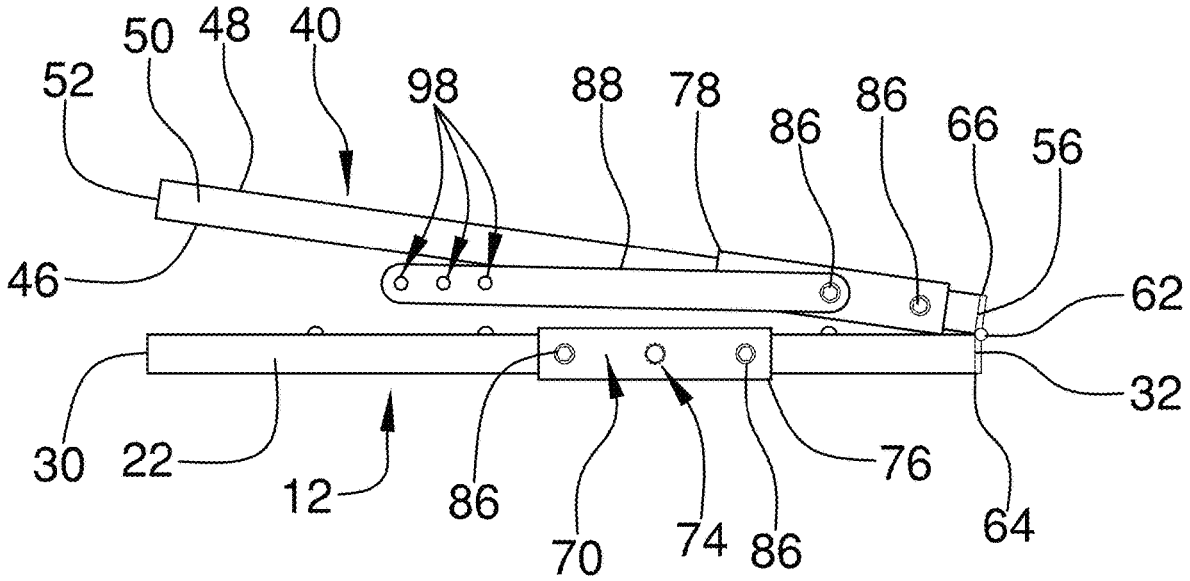
FIG. 5 is a left side view of an embodiment of the disclosure showing an arm being unattached to a mattress panel and showing a headboard being folded over the mattress panel.
Figure 6:
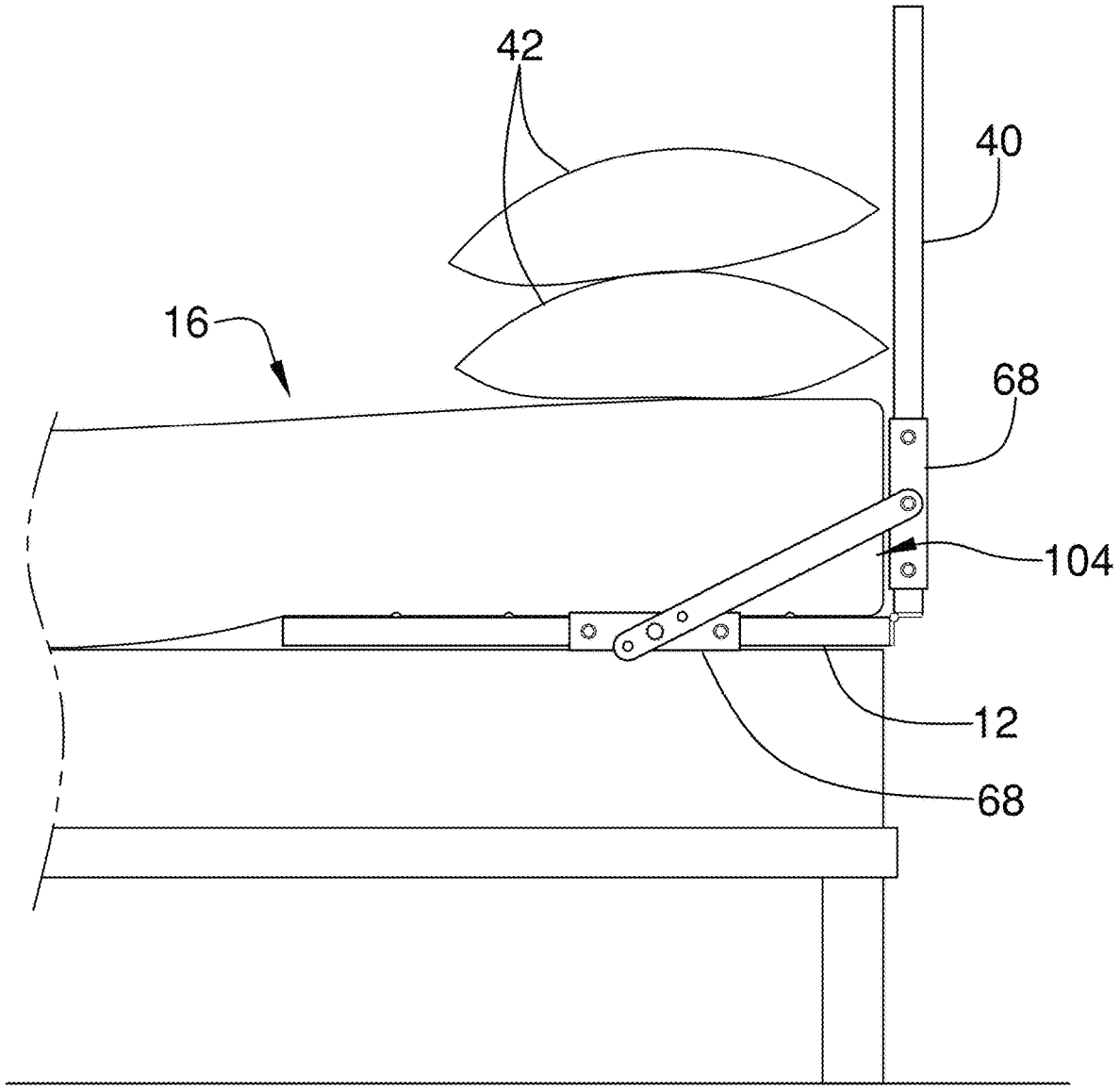
FIG. 6 is a perspective view of an embodiment of the disclosure showing a headboard in an upright orientation.
Figure 7:
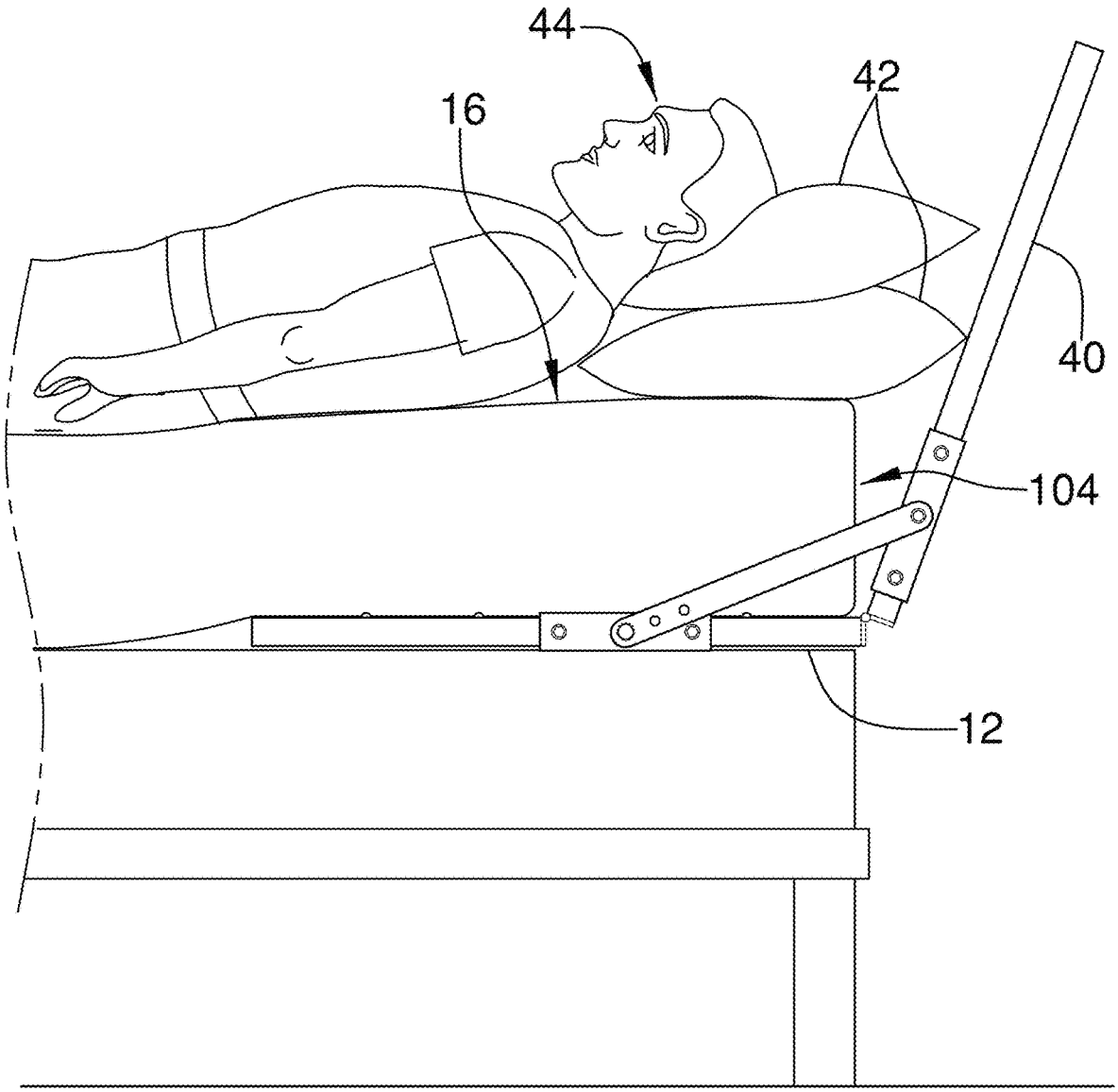
FIG. 7 is a perspective in-use view of an embodiment of the disclosure showing a headboard in an angled orientation.

With reference now to the drawings, and in particular to FIGS. 1 through 7 thereof, a new headboard device embodying the principles and concepts of an embodiment of the disclosure and generally designated by the reference numeral 10 will be described.

As best illustrated in FIGS. 1 through 7, the adjustable headboard device 10 generally comprises a mattress panel 12 that has a plurality of ridges 14 each extending upwardly from the mattress panel 12. Each of the ridges 14 can engage a mattress 16 when the mattress panel 12 is positioned beneath the mattress 16 thereby inhibiting the mattress panel 12 from sliding out of a preferred orientation on the mattress 16. The mattress 16 may be a sleeping mattress of any conventional design and the mattress panel 12 may be positioned between the mattress 16 and a box spring, for example, or any other surface upon which the mattress 16 is positioned. Additionally, the mattress panel 12 is split into a first half 15 and a second half 17. The mattress panel 12 has a top wall 18 and a bottom wall 20 and a perimeter wall 22 extending between the top wall 18 and the bottom wall 20. Each of the plurality of ridges 14 extends upwardly from a top surface 24 of the top wall 18 and each of the plurality of ridges 14 extends between a first lateral side 26 and a second lateral side 28 of the perimeter wall 22. Additionally, the ridges 14 are evenly spaced apart from each other and are distributed between a front side 30 and a back side 32 of the perimeter wall 22. Each of the top wall 18 and the bottom wall 20 curves upwardly adjacent to the back side 32 of the perimeter wall 22.

The mattress panel 12 is substantially hollow and the front side 30 is open into an interior of the mattress panel 12. The top wall 18 has a first cut out 34 extending from the front side 30 toward the back side 32 and the first cut out 34 is centrally located between the first lateral side 26 and the second lateral side 28. The bottom wall 20 has a second cut out 36 extending from the front side 30 toward the back side 32 and the second cut out 36 is aligned with the first cut out 34. The mattress panel 12 has a cut 37 extending through the top wall 18 and the bottom wall 20. The cut 37 extends between the front side 30 and the back side 32 of the perimeter wall 22 to define the first half 15 and the second half 17 of the mattress panel 12. Furthermore, the cut 37 is centrally located between the first lateral side 26 and the second lateral side 28 of the perimeter wall 22.

A first sliding panel 38 is provided and the first sliding panel 38 is slidably positioned within the mattress panel 12. The first sliding panel 38 is positionable in a stored position having the first sliding panel 38 being contained in the mattress panel 12. Conversely, the first sliding panel 38 is positionable in a deployed position having the first sliding panel 38 extending outwardly from the front side 30 of the perimeter wall 22 of the mattress panel 12. Each of the first cut out 34 and the second cut out 36 facilitate gripping the first sliding panel 38 when the first sliding panel 38 is in the stored position. Additionally, the first sliding panel 38 is split into a first half 37 and a second half 39 which is each positioned in a respective one of the first half 15 and the second half 17 of the mattress panel.

A headboard 40 is hingedly coupled to the mattress panel 12 such that the headboard 40 extends upwardly beyond the mattress 16 when the mattress panel 12 is positioned beneath the mattress 16. In this way the headboard 40 can retain pillows 42 at a preferred orientation for a user's 44 sleeping position. Additionally, the headboard 40 is split into a primary half 43 and a secondary half 45. The headboard 40 has a front wall 46, a back wall 48 and an outer wall 50 extending between the front wall 46 and the back wall 48; the headboard 40 is substantially hollow and a top side 52 of the outer wall 50 is open into an interior of the headboard 40. The front wall 46 has a third cut out 54 extending from the top side 52 toward a bottom side 56 of the outer wall 50 and the third cut out 54 is centrally located along the top side 52. Additionally, the bottom wall 20 has a fourth cut out 58 extending from the top side 52 toward the bottom side 56 and the fourth cut out 58 is aligned with the third cut out 54. The headboard 40 has a cut 55 extending through the front wall 46 and the back wall 48. The cut 55 in the headboard 40 extends between the top side 52 of the outer wall 50 and the bottom side 56 of the outer wall 50 to define the primary half 43 and the secondary half 45 of the headboard 40. Furthermore, the cut 55 in the headboard 40 is centrally positioned between a first sidelong side 57 and a second sidelong side 59 of the outer wall 50 of the headboard 40.

A second sliding panel 60 is provided and the second sliding panel 60 is slidably positioned within the headboard 40. The second sliding panel 60 is positionable in a stored position having the second sliding panel 60 being contained in the headboard 40. Conversely, the second sliding panel 60 is positionable in a deployed position having the second sliding panel 60 extending outwardly from the top side 52 of the outer wall 50 of the headboard 40. Each of the third cut out 54 and the fourth cut out 58 facilitate the second sliding panel 60 to be gripped when the second sliding panel 60 is in the stored position. The second sliding panel 60 is split into a primary half 61 and a secondary half 63 each positioned in a respective one of the primary half 43 and the secondary half 45 of the headboard 40.

A hinge 62 is included which comprises a first section 64 of the hinge 62 that is hingedly coupled to a second section 66 of the hinge 62. The first section 64 is coupled to the bottom side 56 of the outer wall 50 of the headboard 40 having the first section 64 extending along a full length of the bottom side 56. The second section 66 is coupled to the back side 32 of the perimeter wall 22 of the mattress panel 12 having the second section 66 extending along a full length of the back side 32 thereby hingedly retaining the headboard 40 on the mattress panel 12.

A plurality of brackets 68 is provided and each of the plurality of brackets 68 is attached to a respective one of the mattress panel 12 and the headboard 40. Each of the plurality of brackets 68 comprises a central panel 70 extending between and being perpendicularly oriented with a pair of outward panels 72 such that each of the plurality of brackets 68 has a C-shape. Each of the plurality of brackets 68 a hole 74 extending through the central panel 70 at a point that is centrally located on the central panel 70.

The plurality of brackets 68 includes a set of first brackets 76 and a second of second brackets 78. Each of the first brackets 76 is positioned on the mattress panel 12 having the central panel 70 of each of the first brackets 76 abutting a respective one of the first lateral side 26 and the second lateral side 28 of the perimeter wall 22 of the mattress panel 12; each of the outward panels 72 of each of the first brackets 76 abuts a respective one of the top wall 18 and the bottom wall 20 of the mattress panel 12. Additionally, each of the first brackets 76 is positioned closer to the back side 32 of the perimeter wall 22 than the front side 30 of the perimeter wall 22 of the mattress panel 12. The hole 74 in the central panel 70 of each of the pair of first brackets 76 is aligned with a well 80 in the respective first lateral side 26 and second lateral side 28 of the perimeter wall 22 of the mattress panel 12.

Each of the second brackets 78 is positioned on the headboard 40 having the central panel 70 of each of the second brackets 78 abutting a respective one of a first lateral side 82 and a second lateral side 84 of the outer wall 50 of the headboard 40 such that each of the outward panels 72 of each of the second brackets 78 abuts a respective one of the front wall 46 and the back wall 48 of the headboard 40. Each of the second brackets 78 is positioned closer to the bottom side 56 of the outer wall 50 of the headboard 40 than the top side 52 of the outer wall 50 of the headboard 40. A plurality of fasteners 86 each extends through the central panel 70 of a respective one of the plurality of brackets 68 and engages a respective one of the mattress panel 12 and the headboard 40 for attaching each of the plurality of brackets 68 to the respective mattress panel 12 and headboard 40. Each of the plurality of fasteners 86 may comprise a screw or other type of threaded fastener.

A pair of arms 88 is provided and each of the pair of arms 88 is pivotally attached to the brackets 68 which are attached to the headboard 40. Each of the pair of arms 88 has an engagement point 90 and which is elongated along a respective arm 88. The engagement point 90 on each of the pair of arms 88 is attachable to a respective one of the brackets 68 which are attached to the mattress panel 12. In this way the headboard 40 is retained at an adjustable angle with respect to the mattress panel 12. Each of the pair of arms 88 has a first end 91, a second end 92, a front surface 94 and a back surface 96. Each of the pair of arms 88 is pivotally attached to the central panel 70 of a respective one of the second brackets 78 at a pivot point 97 that is located adjacent to the first end 91 of the arms 88.

Each of the pair of arms 88 has a slot 98 extending through the front surface 94 and the back surface 96 such that the slot 98 in each of the pair of arms 88 defines the engagement point 90 of each of the pair of arms 88. The slot 98 in each of the pair of arms 88 is elongated between a point located adjacent to the second end 92 of a respective arm 88 toward the first end 91 of the respective arm 88. Additionally, the slot 98 in each of the pair of arms 88 is aligned with the hole 74 in the central panel 70 of a respective one of the first brackets 76 for orienting the headboard 40 at a selected angle with the mattress panel 12.

A pair of screws 100 is provided and each of the pair of screws 100 is extendable through the slot 98 in a respective one of the pair of arms 88 that is aligned with the hole 74 in the central panel 70 of the respective first bracket 76. Each of the screws 100 extends into the well 80 in a respective one of the first lateral side 26 and the second lateral side 28 of the perimeter wall 22 of the mattress panel 12 thereby retaining the headboard 40 at the selected angle with the mattress panel 12. Furthermore, each of the screws 100 threadably engages a bounding surface 102 of the well 80 in the respective first lateral side 26 and the second lateral side 28 of the perimeter wall 22 of the mattress panel 12 for securing each of the pair of arms 88 to the respective first bracket 76. In this way the headboard 40 is retained at the selected angle and can be adjusted at any time by loosening the screws 100 and sliding the slot 98 along the hole 74 in the central panel 70 of the respective first bracket 76 and subsequently tightening the screws 100.

A pair of first tracks 104 is each attached to the bottom wall 20 of the first half 15 of the mattress panel 12. Each of the pair of first tracks 104 extends from the cut 37 in the bottom wall 20 of the mattress panel 12 toward the second lateral side 28 of the perimeter wall 22 of the mattress panel 12. Additionally, the first tracks 104 are spaced apart from each other and are distributed between the front side 30 and the back side 32 of the perimeter wall 22 of the mattress panel 12.

A pair of second tracks 106 is each attached to the bottom wall 20 of the second half 17 of the mattress panel 12 and each of the pair of second tracks 106 extends from the cut 37 in the bottom wall 20 of the mattress panel 12 toward the first lateral side 26 of the perimeter wall 22 of the mattress panel 12. Each of the pair of second tracks 106 slidably engages a respective one of the pair of first tracks 104 thereby facilitating the first half 15 and the second half 17 of the mattress panel 12 to be positioned in a first position having the first half 15 abutting the second half 17 or a second position having the first half 15 being spaced from the second half 17.

A pair of third tracks 108 is each attached to the back wall 48 of the primary half 43 of the headboard 40 and each of the pair of third tracks 108 extends from the cut 55 in the back wall 48 of the headboard 40 toward the first sidelong side 57 of the outer wall 50 of the headboard 40. The third tracks 108 are spaced apart from each other and are distributed between the top side 52 and the bottom side 56 of the outer wall 50 of the headboard 40. A pair of fourth tracks 110 is each attached to the back wall 48 of the secondary half 45 of the headboard 40. Each of the pair of fourth tracks 110 extends from the cut 55 in the back wall 48 of the headboard 40 toward the first sidelong side 57 of the outer wall 50 of the headboard 40. Additionally, each of the pair of fourth tracks 110 slidably engages a respective one of the pair of third tracks 108 thereby facilitating the primary half 43 and the secondary half 45 of the headboard 40 to be positioned in a first position having the primary half 43 abutting the secondary half 45 or a second position having the primary half 43 being spaced from the secondary half 45.

A first insert 112 is provided and the first insert 112 is slidable between the first half 15 and the second half 17 of the mattress panel 12 when the first half 15 and the second half 17 are positioned in the second position. The first insert 112 may be manufactured in a variety of widths to facilitate the mattress panel 12 to accommodate a king sized mattress or a queen sized mattress. A second insert 114 is provided and the second insert 114 is slidable between the primary half 43 and the secondary half 45 of the headboard 40 when the primary half 43 and the secondary half 45 are positioned in the second position. The second insert 114 may be manufactured in a variety of widths to facilitate the headboard 40 to accommodate a king sized mattress or a queen sized mattress.

In use, the mattress panel 12 is slid beneath the mattress 16 such that the headboard 40 extends upwardly along a head end 116 of the mattress 16. The headboard 40 is positioned at one of a variety of angles such the slot 98 in each of the arms 88 is aligned with the hole 74 in the central panel 70 of the respective first bracket 76. Each of the screws 100 is extended through the slot 98 in a respective arm 88 and the hole 74 in the central panel 70 of the respective first bracket 76 and threaded into the well 80 in the respective first lateral side 26 and second lateral side 28 of the perimeter wall 22 of the mattress panel 12. In this way the arms 88 are secured to the mattress panel 12 for retaining the headboard 40 at the selected angle. Additionally, each of the first sliding panel 38 and the second sliding panel 60 can be urged into the deployed position, if desired, to increase the overall length of the mattress panel 12 or the headboard 40, depending upon the user's 44 wishes, or to accommodate the structure of the mattress 16. The first half 15 and the second half 17 of the mattress panel 12 can be urged into the second position and the first insert 112 can be slid between the first half 15 and the second half 17 to accommodate a king sized mattress 16 or a queen sized mattress 16. Additionally, the primary half 43 and the secondary half 45 of the headboard 40 can be urged into the second position and the second insert 114 can be slid between the primary half 43 and the secondary half 45 to accommodate a king sized mattress 16 or a queen sized mattress 16.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable headboard device being positionable at a variety of angles with respect to a mattress for enhancing comfort for a user's sleeping position, said device comprising:

a mattress panel having a plurality of ridges each extending upwardly from said mattress panel thereby facilitating each of said ridges to engage a mattress when said mattress panel is positioned beneath said mattress thereby inhibiting said mattress panel from sliding out of a preferred orientation on said mattress, said mattress panel being split into a first half and a second half;

a headboard being hingedly coupled to said mattress panel such that said headboard extends upwardly beyond said mattress when said mattress panel is positioned beneath said mattress wherein said headboard is configured to retain pillows at a preferred orientation for user's sleeping position, said headboard being split into a primary half and a secondary half;

a plurality of brackets, each of said plurality of brackets being attached to a respective one of said mattress panel and said headboard;

a pair of arms, each of said pair of arms being pivotally attached to said brackets which are attached to said headboard, each of said pair of arms having an engagement point which is elongated along a respective arm, said engagement point on each of said pair of arms being attachable to a respective one of said brackets which are attached to said mattress panel at a selected point along said engagement point thereby retaining said headboard at an adjustable angle with respect to said mattress panel;

wherein said headboard has a front wall and a back wall and an outer wall extending between said front wall and said back wall;

wherein said headboard is substantially hollow;

wherein a top side of said outer wall is open into an interior of said headboard;

wherein said front wall has a third cut out extending from said top side toward a bottom side of said outer wall;

wherein said third cut out is centrally located along said top side;

wherein said bottom wall has a fourth cut out extending from said top side toward said bottom side; and wherein said fourth cut out is aligned with said third cut out.

2. An adjustable headboard device being positionable at a variety of angles with respect to a mattress for enhancing comfort for a user's sleeping position, said device comprising:

a mattress panel having a plurality of ridges each extending upwardly from said mattress panel thereby facilitating each of said ridges to engage a mattress when said mattress panel is positioned beneath said mattress thereby inhibiting said mattress panel from sliding out of a preferred orientation on said mattress, said mattress panel being split into a first half and a second half;

a headboard being hingedly coupled to said mattress panel such that said headboard extends upwardly beyond said mattress when said mattress panel is positioned beneath said mattress wherein said headboard is configured to retain pillows at a preferred orientation for user's sleeping position, said headboard being split into a primary half and a secondary half;

a plurality of brackets, each of said plurality of brackets being attached to a respective one of said mattress panel and said headboard;

a pair of arms, each of said pair of arms being pivotally attached to said brackets which are attached to said headboard, each of said pair of arms having an engagement point which is elongated along a respective arm, said engagement point on each of said pair of arms being attachable to a respective one of said brackets which are attached to said mattress panel at a selected point along said engagement point thereby retaining said headboard at an adjustable angle with respect to said mattress panel;

wherein said mattress panel has a top wall, a bottom wall and a perimeter wall extending between said top wall and said bottom wall;

wherein each of said plurality of ridges extends upwardly from a top surface of said top wall;

wherein each of said plurality of ridges extends between a first lateral side and a second lateral side of said perimeter wall;

wherein said plurality of ridges is evenly spaced apart from each other and is distributed between a front side and a back side of said perimeter wall;

wherein said mattress panel is substantially hollow;

wherein said front side is open into an interior of said mattress panel;

wherein said top wall has a first cut out extending from said front side toward said back side;

wherein said first cut out is centrally located between said first lateral side and said second lateral side;

wherein said bottom wall has a second cut out extending from said front side toward said back side;

wherein said second cut out is aligned with said first cut out; and wherein each of said top wall and said bottom wall curves upwardly adjacent to said back side of said perimeter wall.

3. The assembly according to claim 2, wherein:

said mattress panel has a cut extending through said top wall and said bottom wall;

said cut extends between said front side and said back side of said perimeter wall to define said first half and said second half of said mattress panel; and said cut is centrally located between said first lateral side and said second lateral side of said perimeter wall.

4. The device according to claim 2, wherein:

said device includes a first sliding panel being slidably positioned within said mattress panel;

said first sliding panel is positionable in a stored position having said first sliding panel being contained in said mattress panel;

said first sliding panel is positionable in a deployed position having said first sliding panel extending outwardly from said front side of said perimeter wall of said mattress panel; and said first sliding panel is split into a first half and a second half which is each positioned in a respective one of said first half and said second half of said mattress panel.

5. The assembly according to claim 1, wherein:

said headboard has a cut extending through said front wall and said back wall;

said cut in said headboard extends between said top side of said outer wall and said bottom side of said outer wall to define said primary half and said secondary half of said headboard; and said cut in said headboard is centrally positioned between a first sidelong side and a second sidelong side of said outer wall of said headboard.

6. The device according to claim 1, wherein:

said device includes a first sliding panel being slidably positioned within said mattress panel;

said device includes a second sliding panel being slidably positioned within said headboard;

said second sliding panel is positionable in a stored position having said second sliding panel being contained in said headboard;

said second sliding panel is positionable in a deployed position having said second sliding panel extending outwardly from said top side of said outer wall of said headboard; and said second sliding panel is split into a primary half and a secondary half each being positioned in a respective one of said primary half and said secondary half of said headboard.

7. The device according to claim 1, wherein:

said mattress panel has a perimeter wall which has a back side;

said headboard has an outer wall which has a bottom side;

said device includes a hinge comprising a first section of said hinge being hingedly coupled to a second section of said hinge;

said first section is coupled to said bottom side of said outer wall of said headboard having said first section extending along a full length of said bottom side; and said second section is coupled to said back side of said perimeter wall of said mattress panel having said second section extending along a full length of said back side thereby hingedly retaining said headboard on said mattress panel.

8. The device according to claim 1, wherein:

said mattress panel has a top wall, a bottom wall and a perimeter wall extending between said top wall and said bottom wall, said perimeter wall having a first lateral side and a second lateral side;

said headboard has a front wall and a back wall and an outer wall extending between said front wall and said back wall, said outer wall having a first lateral side and a second lateral side;

each of said plurality of brackets comprises a central panel extending between and being perpendicularly oriented with a pair of outward panels such that each of said plurality of brackets has a C-shape;

each of said plurality of brackets has a hole extending through said central panel at a point being centrally located on said central panel;

said plurality of brackets includes a set of first brackets and a second of second brackets;

each of said first brackets is positioned on said mattress panel having said central panel of each of said first brackets abutting a respective one of said first lateral side and said second lateral side of said perimeter wall of said mattress panel such that each of said outward panels of each of said first brackets abuts a respective one of said top wall and said bottom wall of said mattress panel; and each of said second brackets is positioned on said headboard having said central panel of each of said second brackets abutting a respective one of said first lateral side and said second lateral side of said outer wall of said headboard such that each of said outward panels of each of said second brackets abuts a respective one of said front wall and said back wall of said headboard.

9. The device according to claim 8, wherein:

each of said second brackets is positioned closer to a bottom side of said outer wall of said headboard than a top side of said outer wall of said headboard;

each of said first brackets is positioned closer to a back side of said perimeter wall than a front side of said perimeter wall of said mattress panel; and said hole in said central panel of each of said pair of first brackets is aligned with a well in said respective first lateral side and second lateral side of said perimeter wall of said mattress panel.

10. The device according to claim 8, further comprising a plurality of fasteners, each of said plurality of fasteners extending through said central panel of a respective one of said plurality of brackets and engaging a respective one of said mattress panel and said headboard for attaching each of said plurality of brackets to said respective mattress panel and headboard.

11. The device according to claim 6, wherein:

each of said pair of arms has a first end and a second end and a front surface and a back surface each;

each of said pair of arms is pivotally attached to said central panel of a respective one of said second brackets at a pivot point being located adjacent to said first end of said arms;

each of said pair of arms has a slot extending through said front surface and said back surface such that said slot in each of said pair of arms defines said engagement point of each of said pair of arms; and said slot in each of said pair of arms is elongated between a point located adjacent to said second end of a respective arm toward said first end of said respective arm.

12. The device according to claim 11, wherein said slot in each of said pair of arms is aligned with said hole in said central panel of a respective one of said first brackets for orienting said headboard at a selected angle with said mattress panel.

13. The device according to claim 12, wherein:

said device includes a pair of screws;

each of said pair of screws is extendable through said slot in a respective one of said pair of arms that is aligned with said hole in said central panel of said respective first bracket and extends into a well which is integrated into in a respective one of said first lateral side and said second lateral side of said perimeter wall of said mattress panel thereby retaining said headboard at said selected angle with said mattress panel; and each of said screws threadably engages a bounding surface of said well in said respective first lateral side and said second lateral side of said perimeter wall of said mattress panel for securing each of said pair of arms to said respective first bracket.

14. The assembly according to claim 3, wherein:

said device includes a pair of first tracks;

each of said pair of first tracks is attached to said bottom wall of said first half of said mattress panel;

each of said pair of first tracks extends from said cut in said bottom wall of said mattress panel toward said second lateral side of said perimeter wall of said mattress panel;

said pair of first tracks is spaced apart from each other and being distributed between said front side and said back side of said perimeter wall of said mattress panel;

said device includes a pair of second tracks;

each of said pair of second tracks is attached to said bottom wall of said second half of said mattress panel;

each of said pair of second tracks extends from said cut in said bottom wall of said mattress panel toward said first lateral side of said perimeter wall of said mattress panel; and each of said pair of second tracks slidably engages a respective one of said pair of first tracks thereby facilitating said first half and said second half of said mattress panel to be positioned in a first position having said first half abutting said second half or a second position having said first half being spaced from said second half to accommodate mattresses of varying widths.

15. The assembly according to claim 5, wherein:

said device includes a pair of first tracks and a pair of second tracks;

said device includes a pair of third tracks;

each of said pair of third tracks is attached to said back wall of said primary half of said headboard;

each of said pair of third tracks extends from said cut in said back wall of said headboard toward said first sidelong side of said outer wall of said headboard;

said pair of third tracks is spaced apart from each other and is distributed between said top side and said bottom side of said outer wall of said headboard;

said device includes a pair of fourth tracks;

each of said pair of fourth tracks is attached to said back wall of said secondary half of said headboard;

each of said pair of fourth tracks extends from said cut in said back wall of said headboard toward said first sidelong side of said outer wall of said headboard; and each of said pair of fourth tracks slidably engages a respective one of said pair of third tracks thereby facilitating said primary half and said secondary half of said headboard to be positioned in a first position having said primary half abutting said secondary half or a second position having said primary half being spaced from said secondary half to accommodate mattresses of varying widths.

16. The assembly according to claim 14, wherein said device includes a first insert being slidable between said first half and said second half of said mattress panel when said first half and said second half are positioned in said second position.

17. The assembly according to claim 15, wherein said device includes a second insert being slidable between said primary half and said secondary half of said headboard when said primary half and said secondary half are positioned in said second position.

18. An adjustable headboard device being positionable at a variety of angles with respect to a mattress for enhancing comfort for a user's sleeping position, said device comprising:

a mattress panel having a plurality of ridges each extending upwardly from said mattress panel thereby facilitating each of said ridges to engage a mattress when said mattress panel is positioned beneath said mattress thereby inhibiting said mattress panel from sliding out of a preferred orientation on said mattress, said mattress panel being split into a first half and a second half, said mattress panel having a top wall and a bottom wall and a perimeter wall extending between said top wall and said bottom wall, each of said plurality of ridges extending upwardly from a top surface of said top wall, each of said plurality of ridges extending between a first lateral side and a second lateral side of said perimeter wall, said plurality of ridges being evenly spaced apart from each other and being distributed between a front side and a back side of said perimeter wall, said mattress panel being substantially hollow, said front side being open into an interior of said mattress panel, said top wall having a first cut out extending from said front side toward said back side, said first cut out being centrally located between said first lateral side and said second lateral side, said bottom wall having a second cut out extending from said front side toward said back side, said second cut out being aligned with said first cut out, each of said top wall and said bottom wall curves upwardly adjacent to said back side of said perimeter wall, said mattress panel has a cut extending through said top wall and said bottom wall, said cut extends between said front side and said back side of said perimeter wall to define said first half and said second half of said mattress panel, said cut is centrally located between said first lateral side and said second lateral side of said perimeter wall;

a first sliding panel being slidably positioned within said mattress panel, said first sliding panel being positionable in a stored position having said first sliding panel being contained in said mattress panel, said first sliding panel being positionable in a deployed position having said first sliding panel extending outwardly from said front side of said perimeter wall of said mattress panel, said first sliding panel is split into a first half and a second half which is each positioned in a respective one of said first half and said second half of said mattress panel;

a headboard being hingedly coupled to said mattress panel such that said headboard extends upwardly beyond said mattress when said mattress panel is positioned beneath said mattress wherein said headboard is configured to retain pillows at a preferred orientation for user's sleeping position, said headboard being split into a primary half and a secondary half, said headboard having a front wall and a back wall and an outer wall extending between said front wall and said back wall, said headboard being substantially hollow, a top side of said outer wall being open into an interior of said headboard, said front wall having a third cut out extending from said top side toward a bottom side of said outer wall, said third cut out being centrally located along said top side, said bottom wall having a fourth cut out extending from said top side toward said bottom side, said fourth cut out being aligned with said third cut out, said headboard has a cut extending through said front wall and said back wall, said cut in said headboard extends between said top side of said outer wall and said bottom side of said outer wall to define said primary half and said secondary half of said headboard, said cut in said headboard is centrally positioned between a first sidelong side and a second sidelong side of said outer wall of said headboard;

a second sliding panel being slidably positioned within said headboard, said second sliding panel being positionable in a stored position having said second sliding panel being contained in said headboard, said second sliding panel being positionable in a deployed position having said second sliding panel extending outwardly from said top side of said outer wall of said headboard, said second sliding panel being split into a primary half and a secondary half each being positioned in a respective one of said primary half and said secondary half of said headboard;

a pair of first tracks, each of said pair of first tracks being attached to said bottom wall of said first half of said mattress panel, each of said pair of first tracks extending from said cut in said bottom wall of said mattress panel toward said second lateral side of said perimeter wall of said mattress panel, said pair of first tracks being spaced apart from each other and being distributed between said front side and said back side of said perimeter wall of said mattress panel;

a pair of second tracks, each of said pair of second tracks being attached to said bottom wall of said second half of said mattress panel, each of said pair of second tracks extending from said cut in said bottom wall of said mattress panel toward said first lateral side of said perimeter wall of said mattress panel, each of said pair of second tracks slidably engaging a respective one of said pair of first tracks thereby facilitating said first half and said second half of said mattress panel to be positioned in a first position having said first half abutting said second half or a second position having said first half being spaced from said second half;

a pair of third tracks, each of said pair of third tracks being attached to said back wall of said primary half of said headboard, each of said pair of third tracks extending from said cut in said back wall of said headboard toward said first sidelong side of said outer wall of said headboard, said pair of third tracks being spaced apart from each other and being distributed between said top side and said bottom side of said outer wall of said headboard;

a pair of fourth tracks, each of said pair of fourth tracks being attached to said back wall of said secondary half of said headboard, each of said pair of fourth tracks extending from said cut in said back wall of said headboard toward said first sidelong side of said outer wall of said headboard, each of said pair of fourth tracks slidably engaging a respective one of said pair of third tracks thereby facilitating said primary half and said secondary half of said headboard to be positioned in a first position having said primary half abutting said secondary half or a second position having said primary half being spaced from said secondary half;

a hinge comprising a first section of said hinge being hingedly coupled to a second section of said hinge, said first section being coupled to said bottom side of said outer wall of said headboard having said first section extending along a full length of said bottom side, said second section being coupled to said back side of said perimeter wall of said mattress panel having said second section extending along a full length of said back side thereby hingedly retaining said headboard on said mattress panel;

a plurality of brackets, each of said plurality of brackets being attached to a respective one of said mattress panel and said headboard, each of said plurality of brackets comprising a central panel extending between and being perpendicularly oriented with a pair of outward panels such that each of said plurality of brackets has a C-shape, each of said plurality of brackets a hole extending through said central panel at a point being centrally located on said central panel, said plurality of brackets including a set of first brackets and a second of second brackets, each of said first brackets being positioned on said mattress panel having said central panel of each of said first brackets abutting a respective one of said first lateral side and said second lateral side of said perimeter wall of said mattress panel such that each of said outward panels of each of said first brackets abuts a respective one of said top wall and said bottom wall of said mattress panel, each of said first brackets being positioned closer to said back side of said perimeter wall than said front side of said perimeter wall of said mattress panel, said hole in said central panel of each of said pair of first brackets being aligned with a well in said respective first lateral side and second lateral side of said perimeter wall of said mattress panel, each of said second brackets being positioned on said headboard having said central panel of each of said second brackets abutting a respective one of a first lateral side and a second lateral side of said outer wall of said headboard such that each of said outward panels of each of said second brackets abuts a respective one of said front wall and said back wall of said headboard, each of said second brackets being positioned closer to said bottom side of said outer wall of said headboard than said top side of said outer wall of said headboard;

a plurality of fasteners, each of said plurality of fasteners extending through said central panel of a respective one of said plurality of brackets and engaging a respective one of said mattress panel and said headboard for attaching each of said plurality of brackets to said respective mattress panel and headboard;

a pair of arms, each of said pair of arms being pivotally attached to said brackets which are attached to said headboard, each of said pair of arms having an engagement point which is elongated along a respective arm, said engagement point on each of said pair of arms being attachable to a respective one of said brackets which are attached to said mattress panel thereby retaining said headboard at an adjustable angle with respect to said mattress panel, each of said pair of arms having a first end and a second end and a front surface and a back surface each, each of said pair of arms being pivotally attached to said central panel of a respective one of said second brackets at a pivot point being located adjacent to said first end of said arms, each of said pair of arms has a slot extending through said front surface and said back surface such that said slot in each of said pair of arms defines said engagement point of each of said pair of arms, said slot in each of said pair of arms is elongated between a point located adjacent to said second end of a respective arm toward said first end of said respective arm, said slot in each of said pair of arms being aligned with said hole in said central panel of a respective one of said first brackets for orienting said headboard at a selected angle with said mattress panel;

a pair of screws, each of said pair of screws being extendable through said slot in a respective one of said pair of arms that is aligned with said hole in said central panel of said respective first bracket and extending into said well in a respective one of said first lateral side and said second lateral side of said perimeter wall of said mattress panel thereby retaining said headboard at said selected angle with said mattress panel, each of said screws threadably engaging a bounding surface of said well in said respective first lateral side and said second lateral side of said perimeter wall of said mattress panel for securing each of said pair of arms to said respective first bracket;

a first insert being slidable between said first half and said second half of said mattress panel when said first half and said second half are positioned in said second position; and a second insert being slidable between said primary half and said secondary half of said headboard when said primary half and said secondary half are positioned in said second position.

* * * * *